US007665264B1

(12) United States Patent
Wolfe

(10) Patent No.: US 7,665,264 B1
(45) Date of Patent: Feb. 23, 2010

(54) METAL-FACED BUILDING PANELS HAVING ANGLED PROJECTIONS IN LONGITUDINAL EDGE RECESSES FOR MATING WITH LOCKING RAMPS ON FLANGES OF CONCEALED I-SHAPED CONNECTOR

(76) Inventor: Michael J. Wolfe, 773 Wesley Ave., Tarpon Springs, FL (US) 34689

( * ) Notice: Subject to any disclaimer, the term of this patent is extended or adjusted under 35 U.S.C. 154(b) by 235 days.

(21) Appl. No.: 11/247,830

(22) Filed: Oct. 11, 2005

Related U.S. Application Data

(63) Continuation-in-part of application No. 10/677,773, filed on Oct. 2, 2003, now Pat. No. 7,021,014, which is a continuation-in-part of application No. 09/788,793, filed on Feb. 20, 2001, now abandoned.

(51) Int. Cl.
*E04B 2/00* (2006.01)

(52) U.S. Cl. ..... 52/586.2; 52/763

(58) Field of Classification Search ..... 52/763, 52/762, 582.1, 586.1, 586.2; 403/292, 293, 403/329, 397
See application file for complete search history.

(56) References Cited

U.S. PATENT DOCUMENTS 1,990,656 A * 2/1935 Kotrbaty ..... 52/243
3,293,812 A * 12/1966 Hammitt ..... 52/238.1
3,348,459 A * 10/1967 Harvey ..... 404/35
3,512,819 A * 5/1970 Morgan et al. ..... 52/461
3,605,363 A * 9/1971 Bard ..... 52/241
3,640,039 A * 2/1972 McKee et al. ..... 52/281
4,128,983 A * 12/1978 Matsubara ..... 52/779
4,635,422 A * 1/1987 Nowack et al. ..... 52/406.1
4,730,428 A * 3/1988 Head et al. ..... 52/309.11
5,007,222 A * 4/1991 Raymond ..... 52/586.1
5,056,290 A * 10/1991 Alexander et al. ..... 52/582.1
5,058,333 A * 10/1991 Schwartz ..... 52/73
5,062,250 A * 11/1991 Buzzella ..... 52/586.2
5,086,599 A * 2/1992 Meyerson ..... 52/309.9
5,592,794 A * 1/1997 Tundaun ..... 52/220.7
5,609,435 A * 3/1997 Nomura ..... 403/387
5,613,338 A * 3/1997 Esposito ..... 52/588.1
5,706,620 A * 1/1998 De Zen ..... 52/220.2
5,950,389 A * 9/1999 Porter ..... 52/586.1
6,185,891 B1 * 2/2001 Moore ..... 52/309.7
6,298,619 B1 * 10/2001 Davie ..... 52/293.3
7,418,805 B2 * 9/2008 Tan ..... 52/582.2
2003/0079428 A1 * 5/2003 Rivers ..... 52/270
2003/0196404 A1 * 10/2003 Dennis ..... 52/582.1
2004/0083675 A1 * 5/2004 Grimes ..... 52/586.2
2004/0118069 A1 * 6/2004 Budge ..... 52/582.1
2004/0139676 A1 * 7/2004 Knauseder ..... 52/578
2006/0185305 A1 * 8/2006 Schaffer ..... 52/586.1

* cited by examiner

*Primary Examiner*—Gay Ann Spahn

(57) ABSTRACT

Metal faced insulated inserts have interior and exterior surfaces with parallel longitudinal edges between an upper and lower short edge. Each longitudinal edge of each insert has two deep recesses and a central shallow recess. A plurality of generally I-shaped concealed locking beams have a central section and parallel end sections. Each end section has a central region of a thickness less than end regions to form a locking ramp. A pair of similarly configured metal facings for each concealed locking beam with opposed end parts are located within the deep recesses at the longitudinal edges of each insert. Each end part terminates in a V-shaped projection configured to allow the end regions of the concealed edge lockings to compress the V-shaped projections and allow the end regions of the concealed locking beams to mate with the metal facings.

2 Claims, 5 Drawing Sheets

FIG 1
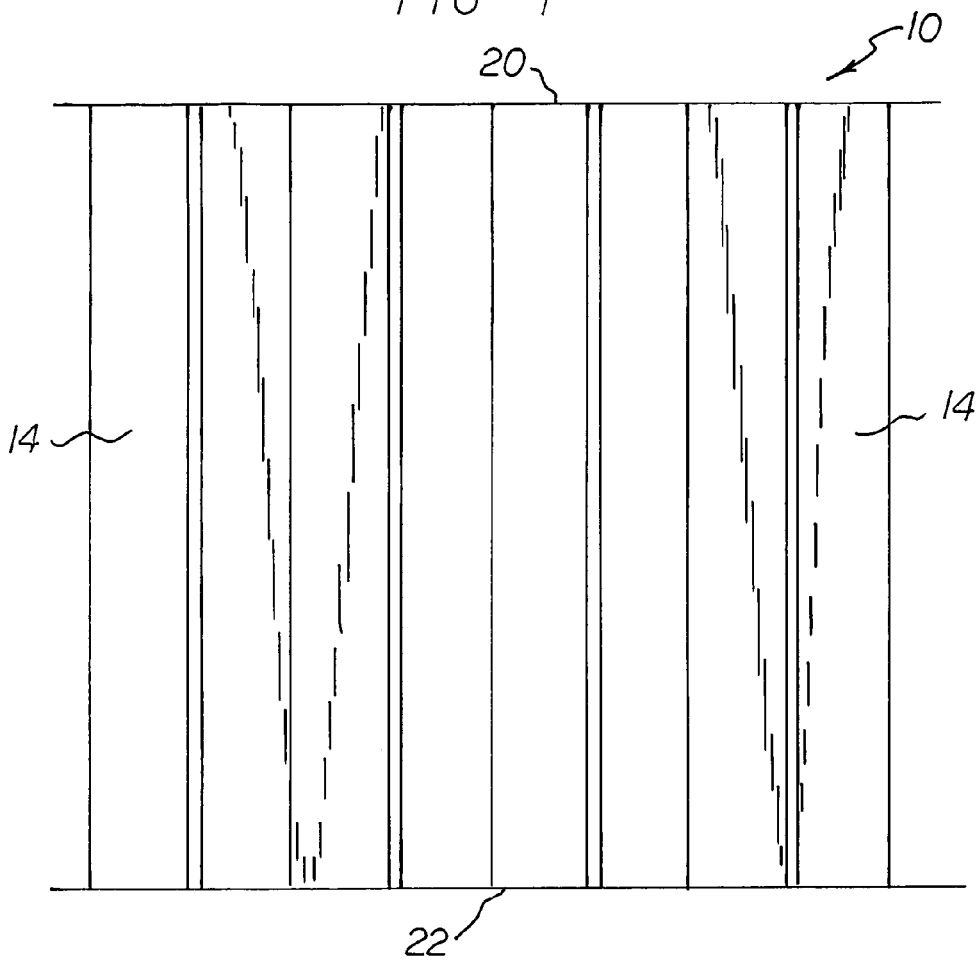
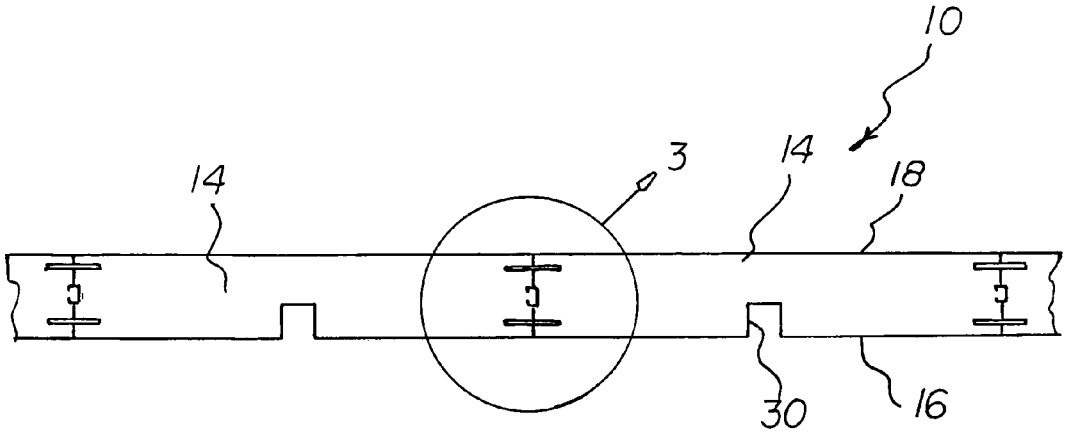
FIG 2

FIG 3
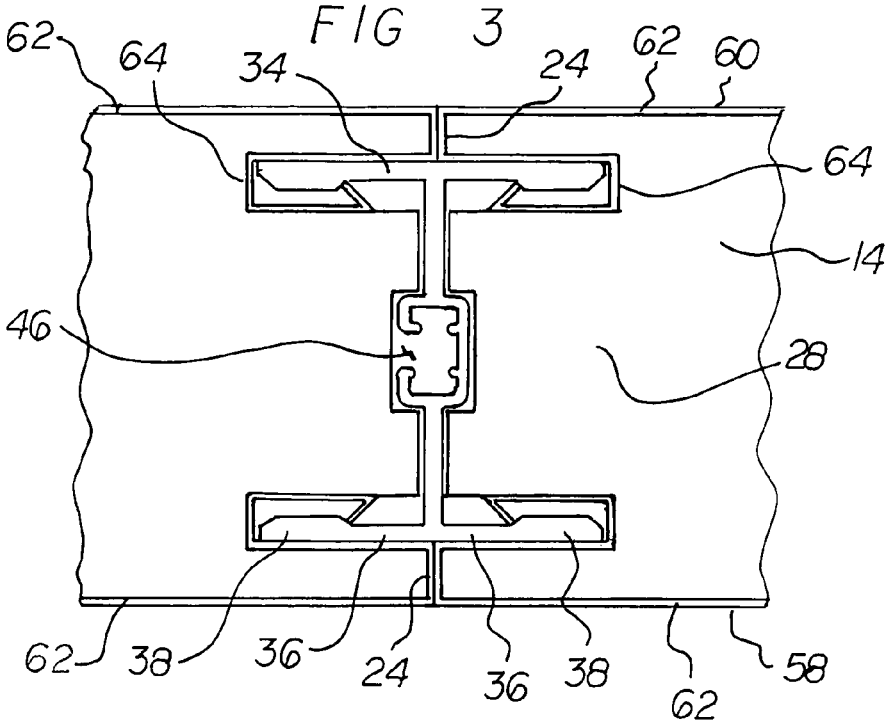
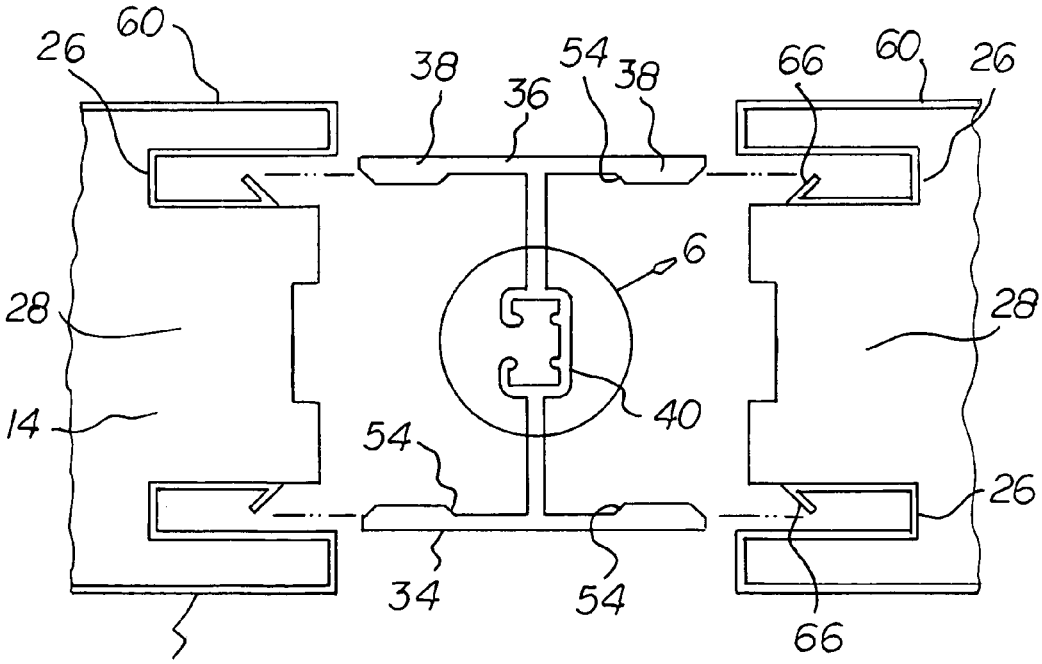
FIG 4

FIG 5
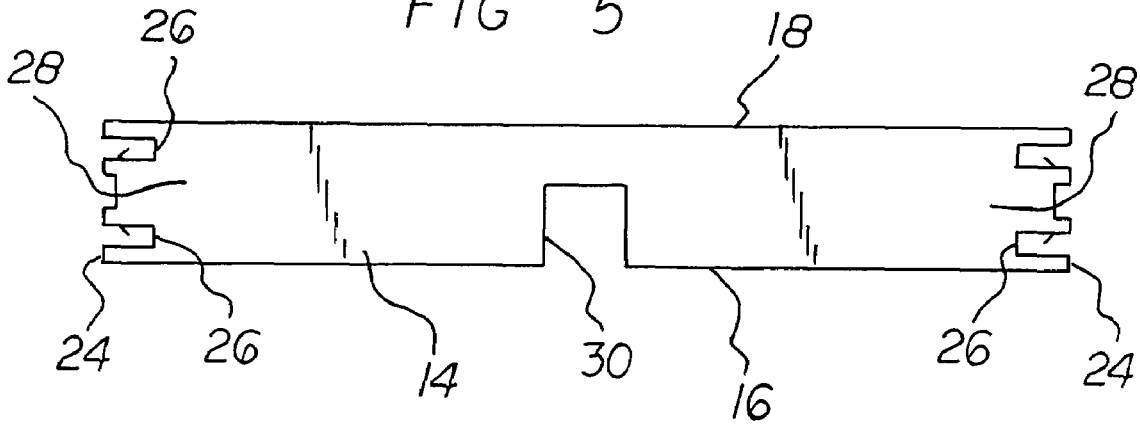
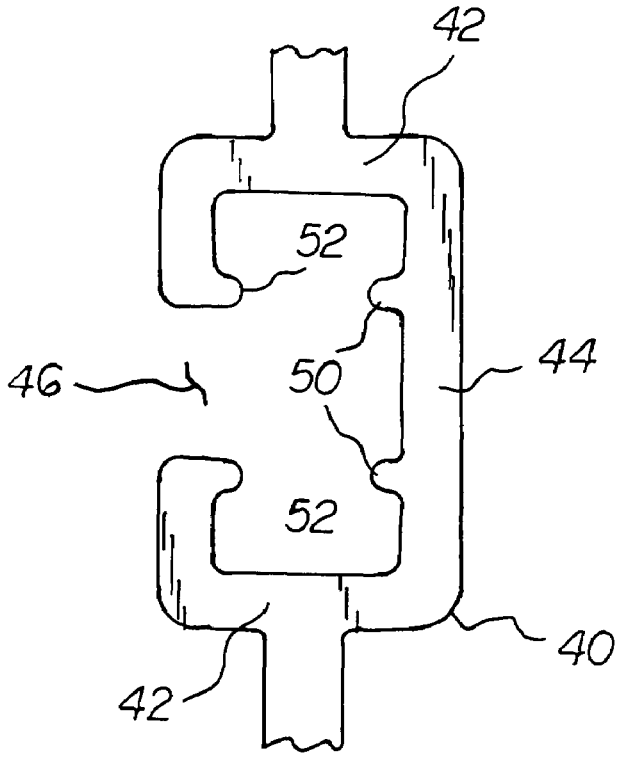
FIG 6

FIG 9
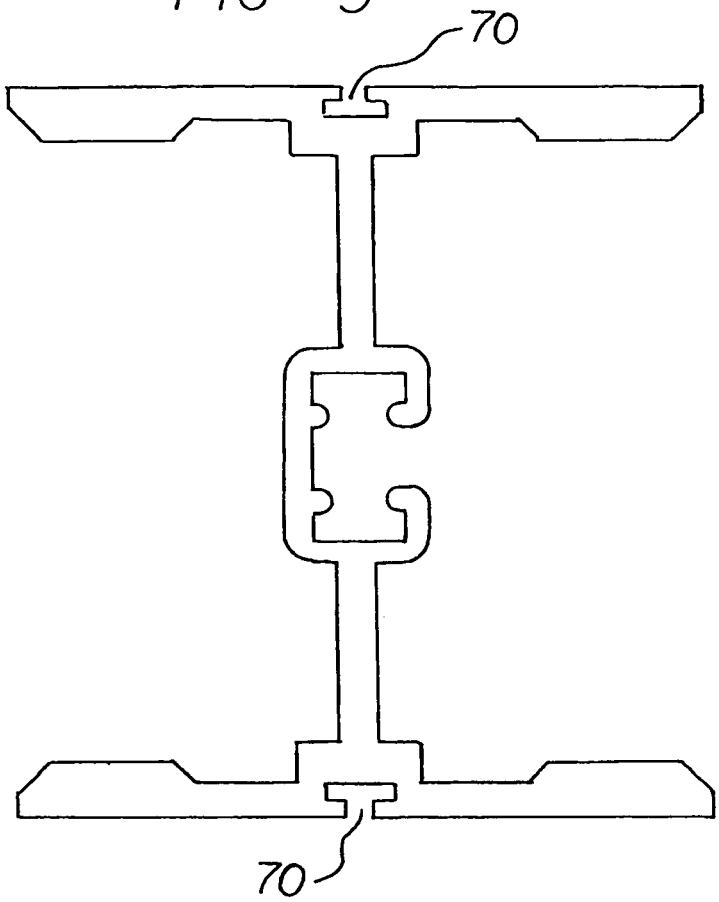
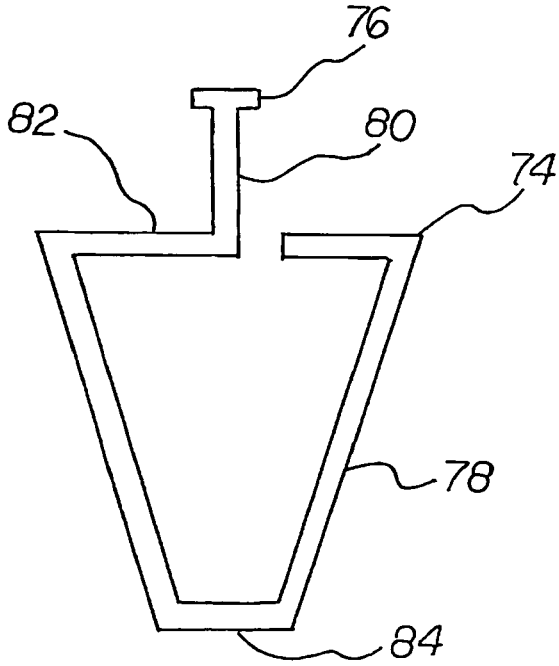
FIG 10

METAL-FACED BUILDING PANELS HAVING ANGLED PROJECTIONS IN LONGITUDINAL EDGE RECESSES FOR MATING WITH LOCKING RAMPS ON FLANGES OF CONCEALED I-SHAPED CONNECTOR

RELATED APPLICATIONS

The present application is a continuation-in-part application of U.S. patent application Ser. No. 10/677,773 filed Oct. 2, 2003, now U.S. Pat. No. 7,021,014, which is in turn a continuation-in-part application of U.S. patent application Ser. No. 09/788,793 filed Feb. 20, 2001, now abandoned, the subject matter of which applications is incorporated herein by reference.

BACKGROUND OF THE INVENTION

1. Field of the Invention

The present invention relates to a structural wall and roof assembly and more particularly pertains to coupling metal faced insulated inserts with concealed locking beams.

2. Description of the Prior Art

The use of building systems of known designs and configurations is known in the prior art. More specifically, building systems of known designs and configurations previously devised and utilized for the purpose of building through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,373,678 issued to Hesser on Dec. 20, 1994 relates to a Structural Panel System. This patent is an original design for the internal stiffener that is formed as an integral part of the panel during the panel manufacturing process. The stiffener is roll formed separately from the steel skins and placed in between the skins by hand. The present application does not use a roll formed stiffener that is placed in between the skins during the manufacturing process. Although Hesser attempts to structurally stiffen his panel, the nature and configuration of his added device does not achieve its purpose.

U.S. Pat. No. 5,509,242 issued to Rechsteiner on Apr. 23, 1996 relates to a Structural Insulated Building Panel System. This patent uses various steel shapes including angles and flat bar that are inserted into the foam at the panel edges to add structural strength. The present application does not use small angles and bars inserted into the panel edge.

U.S. Pat. No. 5,827,458 issued to Meadows on Oct. 27, 1998 relates to a Continuous Method of Making Structural Foam Panels. This patent is for the continuous manufacturing process wherein the internal stiffener stud designed by Hesser is formed on a continuous manufacturing line and is formed simultaneously with the interior and exterior metal skins. This is an improvement over the original Hesser manufacturing process. The present application does not form the stiffener stud on a continuous manufacturing line simultaneous with the panel.

U.S. Pat. No. 6,279,287 issued to Meadows on Aug. 18, 2001 relates to a Prefabricated Building Panel and Method of Manufacturing Same. This patent is for an edge design that differs from the Hesser patent and uses a gasket between the panel edges. The present application does not use this edge design or the gaskets required to join the panels.

U.S. Pat. No. 5,927,032 issued to Record on Jul. 27, 1999 relates to an Insulated Building Panel with a Unitary Shear Resistance Connector Array. This patent is for a cluster array that somehow adds rigidity to the panel by incorporating an internal blocking design. The blocks can not be installed on a continuous line and must be placed by hand. This is expensive and does not lend itself to high speed production. Also, it does not have a vertical edge reinforcement beam. The present application does not relate to a cluster array and can be produced on a high speed line.

Other prior art relates to a snap-lock panel edge design that enables the adjacent edges of a panel to snap fit with one another. The skins are shaped to snap together. There is no reinforcing beam or integral electrical chase. The present application relates to a concealed locking beam that locks into a metal faced insulated insert with a continuous locking leg formed into the metal faced insulated insert edge. The inserts can not be joined together without the beam.

While these devices fulfill their respective, particular objectives and requirements, the aforementioned devices fit the specific definition of individual panels and are used primarily as cladding materials that are mechanically fastened to a structural frame and are not suitable for use as the primary structural member or a building. These devices do not describe a structural wall and roof assembly with integral rigid insulation that enables the coupling of metal faced insulated inserts with concealed locking beams that, when fully assembled, can be used as the primary structural member or main wind force resisting system of a building.

In this respect, the structural wall and roof assembly according to the present invention substantially departs from the conventional concepts and designs of the prior art, and in doing so provides an apparatus primarily developed for the purpose of coupling metal faced insulated inserts with concealed locking beams that can be used as the main wind force resisting system in building construction.

Therefore, it can be appreciated that there exists a continuing need for a new and improved structural wall and roof assembly which can be used for coupling metal faced insulated inserts with concealed locking beams. In this regard, the present invention substantially fulfills this need.

SUMMARY OF THE INVENTION

In view of the disadvantages inherent in the known types of building systems of known designs and configurations now present in the prior art, the present invention provides an improved structural wall and roof assembly. As such, the general purpose of the present invention, which will be described subsequently in greater detail, is to provide a new and improved structural wall and roof assembly and method which has all the advantages of the prior art and none of the disadvantages.

To attain this, the present invention essentially comprises a structural wall and roof assembly. First provided is a plurality of metal faced insulated inserts. Each insert has an interior surface and an exterior surface with a horizontal upper edge and a parallel lower edge and with parallel longitudinal edges there between. Each longitudinal edge of each insert has two parallel deep recesses and a centrally located rigid foam core between the deep recesses. Each deep recess extends between the upper and lower edges. Each interior surface of each insert has an electrical chase in a rectilinear configuration extending between the upper and lower edges equally spaced from the longitudinal edges. Each electrical chase has a width and depth greater than the width and depth of each deep recess. Each electrical chase is adapted to hold electrical wires and boxes when covered by an appropriate finishing sheet. Each insert is fabricated of a relatively rigid thermally insulating material selected from the class of rigid thermally insulating materials including polyurethane foam and polystyrene foam.

Next provided are a plurality of concealed locking beams. Each concealed locking beam has a length essentially equal to the length of the metal faced insulated inserts. Each concealed locking beam also has a generally I-shaped configuration with a central web and parallel flanges. The parallel flanges have a common length equal to the length of the central web plus or minus ten percent. The central web contains a thermal brake for thermal integrity with parallel short sides parallel with the end flanges and parallel long sides there between parallel with the central web. One of the long sides has a slot along its entire length. The long side with the slot has a pair of inwardly facing projections. The opposite long side also has a pair of inwardly facing projections. The flanges each have end regions and a central region with the central region of each flange being of a thickness less than the end regions of each end section to form a locking ramp. Each concealed locking beam is fabricated of a relatively rigid material selected from the class of rigid material including extruded aluminum, steel and thermo-plastic material.

Lastly provided are a pair of similarly configured metal facings for each concealed locking beam including an interior metal face positioned on the interior surface of one of the inserts and an exterior metal face positioned on the exterior surface of the insert. Each metal face has an enlarged central part covering a surface of the insert and with opposed edge parts in a generally U-shaped configuration located within the deep recesses at the longitudinal edges of the insert. Each edge part terminates in a V-shaped projection configured to allow the flanges of the concealed locking beams to compress the V-shaped projections and allow the flanges of the concealed locking beams to be received by the edge parts of the metal facings and locked in position by the ends of the V-shaped projections. This creates an interference fit at the locking ramps of the concealed locking beams. Each metal face is fabricated of a metal sheet selected from the class of metal sheets including steel and aluminum.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved structural wall and roof assembly which has all of the advantages of the prior art building systems of known designs and configurations and none of the disadvantages.

It is another object of the present invention to provide a new and improved structural wall and roof assembly which may be easily and efficiently manufactured and marketed.

It is another object of the present invention to provide a new and improved structural wall and roof assembly which is of durable and reliable constructions.

An even further object of the present invention is to provide a new and improved structural wall and roof assembly which is susceptible of a low cost of manufacture with regard to both materials and labor, and which accordingly is then susceptible of low prices of sale to the consuming public, thereby making such structural wall and roof assembly economically available.

Another object of the present invention is to provide a structural wall and roof assembly for coupling metal faced insulated inserts with concealed locking beams.

Further, an object of the present invention is to provide an edge coupling that does not require stitching with a mechanical fastener along the entire longitudinal edge, as is required wit the prior art, thereby creating a strong and continuous diaphragm along the entire face of the assembled wall.

Another object of the invention is to create a structural wall and roof assembly with increased structural properties thereby enabling the construction of free standing rigid frame buildings that are able to withstand hurricane force wind loads.

Another object of the invention is to create wall and roof assembly that can be used as the main wind force resisting system in free standing rigid frame buildings.

It is a further object of the invention to provide a structural wall and roof assembly that is non-combustible and thermally broken having integral rigid insulation and that is environmentally friendly, i.e. green.

Lastly, it is an object of the present invention to provide a new and improved structural panel building system with metal faced insulated inserts having an upper and lower short edge and parallel longitudinal edges there between. Each longitudinal edge of each insert has two deep recesses and a central shallow recess. A plurality of concealed locking beams have a generally I-shaped configuration with a central section and parallel end sections. Each end section has a central region and end regions with the central region being of a thickness less than the end regions of each end section to form a locking ramp. A pair of similarly configured metal facings for each concealed locking beam with opposed end parts are located within the deep recesses at the longitudinal edges of each insert. Each end part terminates in a V-shaped projection configured to allow the end regions of the concealed locking beams to compress the V-shaped projections and allow the end regions of the concealed locking beams to mate with the metal facings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a structural building assembly constructed in accordance with the principles of the present invention.

FIG. 2 is a top view of the assembly illustrated in FIG. 1.

FIG. 3 is an enlarged showing of the concealed locking beam and metal faced insulated insert edge design taken at circle 3 of FIG. 2.

FIG. 4 is an exploded top view of the assembly position shown in FIG. 3.

FIG. 5 is an enlarged top view of one of the metal faced insulated inserts shown in FIG. 2.

FIG. 6 is an enlarged illustration of the thermal break taken at circle 6 of FIG. 4.

FIG. 9 is an enlarged showing of the concealed locking beam of FIG. 7.

FIG. 10 is an enlarged showing of the slide-in metal rib of FIG. 7.

The same reference numerals refer to the same parts throughout the various Figures.

DESCRIPTION OF THE PREFERRED EMBODIMENT

Figure 7:
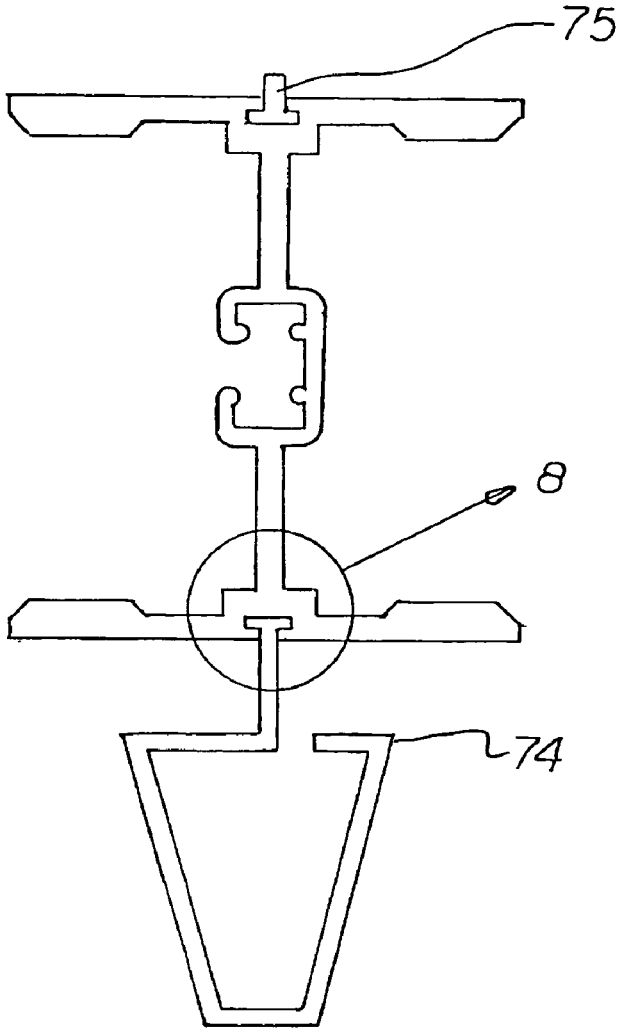
FIG. 7 is a top view of a concealed locking beam constructed in accordance with the principles of an alternate embodiment of the present invention and including an associated slide-in metal rib.

With reference now to the drawings, and in particular to FIG. 1 thereof, the preferred embodiment of the new and improved structural wall and roof assembly embodying the principles and concepts of the present invention and generally designated by the reference numeral 10 will be described.

The present invention, the structural wall and roof assembly 10 is comprised of a plurality of components. Such components in their broadest context include metal faced insulated inserts and concealed locking beams. Such components are individually configured and correlated with respect to each other so as to attain the desired objective.

It is important to differentiate the present invention, which is a wall and roof assembly, from the prior art, which are individual panels. In the prior art the individual panels comprising a wall or roof system are considered to be components and/or cladding materials under the definition of most model building codes and standards. This limits the application and use of panels to cladding materials that must be connected to a separate structural support frame with mechanical fasteners of other means. In this application the main wind force resisting system for the building is actually the support frame.

While the aforementioned prior art described the various attempts that have been made to address this deficiency in the application of building panels so that they can be used in a free standing basis as the main wind force resisting system, none have achieved this objective.

The present invention substantially departs from the prior art because the structural strength of the wall and roof assembly is derived from the combination fo the concealed locking beams and the metal faced insulated inserts. When joined together, these parts form an assembly hat has the structural strength to be used as the main wind force resisting system for the construction of single family homes, school classrooms and other types of rigid frame buildings.

The parts comprising the assembly can be produced at low cost because the concealed locking beams are manufactured according to the extrusions process which is a high speed automated process and the metal faced insulated inserts are manufactured according to the continuous line method which is a high speed automated process and the metal faced insulated inserts are manufactured according to the continuous line method which is a high speed automated process. All of the material used in the manufacture of this assembly are non-combustible, readily available, recyclable and do not deplete our natural resources.

First provided is a plurality of inserts 14. Each insert has an interior surface 16 and an exterior surface 18. Each insert has a horizontal upper edge 20 and a parallel lower edge 22. Each insert has parallel longitudinal edges 24 provided between the upper and lower edges. Each longitudinal edge of each insert has two parallel deep recesses 26. Each longitudinal edge of each panel insert has a centrally located rigid insulating foam core 28. The rigid insulating foam core is provided between the deep recesses. Each deep recess extends between the upper and lower edges. Each interior surface of each insert has an electrical chase 30. The electrical chase is provided in a rectilinear configuration. The electrical chase extends between the upper and lower edges. The electrical chase is equally spaced from the longitudinal edges. The electrical chase has a rectangular configuration. The width and depth of the electrical chase is greater than the width and depth of each deep recess.

Each electrical chase is adapted to hold electrical wires insert is fabricated of a relatively rigid thermally insulating material. The insulating material is selected from the class of rigid thermally insulating materials including polyurethane foam and polystyrene foam.

Provided next is a plurality of concealed locking beams 34. Each concealed locking beam has a length. The length is essentially equal to the length of the inserts. Each concealed locking beam also has a generally I-shaped configuration. Each beam has a central web 36. Each beam has parallel flanges 38. The parallel flanges have a common length. The length is equal to the length of the central web plus or minus ten percent. The central web contains a thermal brake 40. The thermal brake reduces the thermal conductivity of the beam. Each beam has parallel short sides 42. The short sides are parallel with the end flanges. Each beam has parallel long sides 44. The long sides are provided between the short sides. The long sides are parallel with the central web. One of the long sides has a slot 46 provided along its entire length. The long side with the slot has a pair of inwardly facing projections 50. The long side opposite the slot also has a pair of inwardly facing projections 52.

The flanges each have end regions and a central region. The central region of each flange is of a thickness less than the end regions of each flange. In this manner a locking ramp 54 is formed. Each concealed locking beam is fabricated of a relatively rigid material. The rigid material is selected from the class of rigid materials including extruded aluminum, steel and thermo-plastic material.

Further provided is a pair of similarly configured metal facings 58, 60 for each concealed locking beam. The metal facings include an interior surface metal face 58 positioned on the interior surface of each insert. The metal facings also include an exterior metal face 60 positioned on the exterior surface of each insert. Each metal face has an enlarged central part 62. The central part covers a surface of one of the insulated inserts. The metal face has opposed edge parts 64. Each metal face is in a generally U-shaped configuration. The metal face is located within the deep recesses at the longitudinal edges of each insulated insert.

Each edge part terminates in a V-shaped projection 66. The V-shaped projection is configured to allow the flanges of the concealed locking beams to compress the V-shaped projections. The V-shaped projection is further configured to allow the flanges of the concealed locking beams to be received by the edge parts of the metal facings and locked in position by the ends of the V-shaped projections. In this manner an interference fit is created at the locking ramps of the concealed locking beams. Each metal facing is fabricated of a metal sheet. The metal sheet is selected from the class of metal sheets including steel and aluminum.

Figure 8:
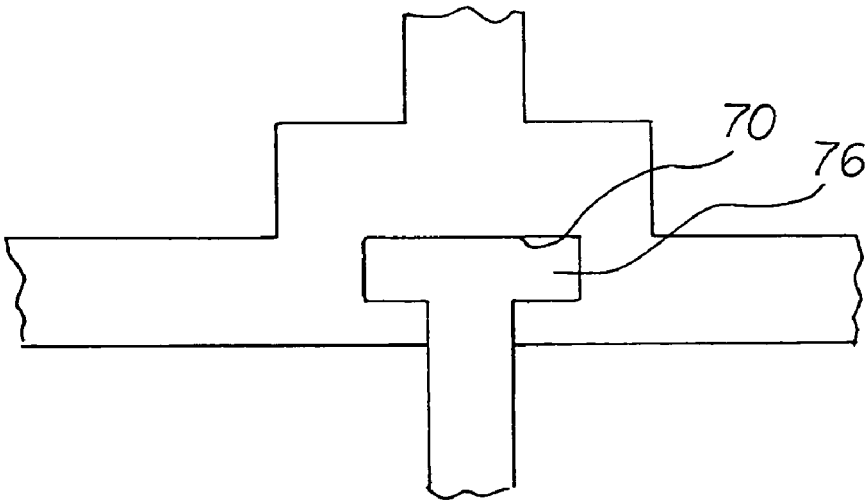
FIG. 8 is an enlarged illustration of the interface between the concealed locking beam and its associated slide-in metal rib taken at circle 8 of FIG. 7.

An alternate embodiment of the present invention is shown in FIGS. 7 through 10. In this embodiment outwardly facing T-shaped recesses 70 are provided. The recesses are formed in each flange of each concealed locking beam. The recesses are adjacent to and extend for the entire length of the ends of the central web.

In this embodiment a slide-in metal rib or gasket 74 is provided. The slide-in metal rib is fabricated of extruded aluminum. The slide-in gasket is fabricated from a thermal plastic material. The slide-in metal rib or gasket has a length essentially equal to the length of the T-shaped recess. The slide-in metal rib has an interior section 76 and an exterior section 78. An intermediate section 80 is provided between the interior and exterior sections. The interior section terminates in a T-shaped cross section. The cross section is slidably received in the T-shaped recess. The exterior section has a keystone-shaped cross sectional configuration with a large face 82 and a small face 84. The large face 82 is positionable in contact with two of the metal faced insulated inserts. The small face 84 is parallel to the large face. The small face is adapted to receive brake formed sheet metal and like structural components with fasteners. The intermediate section is positionable between the adjacent longitudinal edges of the inserts. In addition, the invention is applicable for use in roofing wherein the metal ribs provide a standing seam roof appearance between panels.

In another alternate embodiment, the locking beam has an integrally formed receiving channel wherein a decorative metal rib or gasket 75 may be installed.

In another alternate embodiment the metal rib is replaced by a gasket 75 made of a semi-flexible material such as a foam.

From the foregoing, it may be readily understood that the present invention is a structural wall and roof assembly. Such assembly includes a concealed locking beam which becomes an integral and permanently connected internal reinforcement member. This is caused by locking onto the metal faced insulated insert edge through an interference fit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A structural building assembly comprising:

a plurality of panels having an interior surface and an exterior surface with an upper short edge and a lower short edge and parallel longitudinal edges there between, each longitudinal edge of each panel having two spaced deep recesses and a single central shallow recess equally spaced from the two spaced deep recesses to function as a thermal break to reduce thermal conductivity;

a plurality of concealed locking beams having a generally I-shaped configuration with a central section and parallel end sections, each end section having a central region and end regions with the central region being of a thickness less than the end regions of each end section to form a locking ramp; and a pair of similarly configured metal facings for each concealed locking beam with opposed end parts located within the deep recesses at the longitudinal edges of each panel, each end part terminating in an angled planar projection configured to allow the end regions of the concealed locking beams to move parallel with the interior and exterior surfaces to compress the angled planar projections and locking ramps and allow the end regions of the concealed locking beams to mate with the metal facings.

2. The assembly as set forth in claim 1 and further including:

an outwardly facing T-shaped recess formed in each end section of each concealed locking beam adjacent the central section.

* * * * *